US008142646B2

(12) United States Patent
Choi et al.

(10) Patent No.: US 8,142,646 B2
(45) Date of Patent: Mar. 27, 2012

(54) PROCESS TO PRODUCE LOW SULFUR CATALYTICALLY CRACKED GASOLINE WITHOUT SATURATION OF OLEFINIC COMPOUNDS

(75) Inventors: Ki-Hyouk Choi, Dhahran (SA); Ali H. Al-Shareef, AlNasira Qatif (SA); Sameer A. Al-Ghamdi, Dhahran (SA)

(73) Assignee: Saudi Arabian Oil Company (SA)

( * ) Notice: Subject to any disclaimer, the term of this patent is extended or adjusted under 35 U.S.C. 154(b) by 476 days.

(21) Appl. No.: 12/277,081

(22) Filed: Nov. 24, 2008

(65) Prior Publication Data

US 2009/0145807 A1 Jun. 11, 2009

Related U.S. Application Data

(60) Provisional application No. 60/991,501, filed on Nov. 30, 2007.

(51) Int. Cl.
*C10G 45/00* (2006.01)

(52) U.S. Cl. ..... 208/213; 208/208 R; 208/209; 208/212; 208/216 R; 208/217; 208/250; 208/299; 208/302

(58) Field of Classification Search ..... 208/208 R, 208/209, 212–213, 216 R, 217, 250, 299, 208/302

See application file for complete search history.

(56) References Cited

U.S. PATENT DOCUMENTS

| | | | |
|---|---|---|---|
| 2,880,171 | A | 3/1959 | Flinn et al. |
| 2,944,012 | A | 7/1960 | Thompson |
| 2,967,204 | A | 1/1961 | Beuther et al. |
| 3,116,234 | A | 12/1963 | Douwes et al. |
| 3,501,396 | A | 3/1970 | Gatsis |
| 3,576,596 | A | 4/1971 | Krane et al. |
| 3,586,621 | A | 6/1971 | Pitchford at al. |
| 3,654,139 | A | 4/1972 | Winsor et al. |
| 3,733,259 | A | 5/1973 | Wilson et al. |
| 3,830,752 | A | 8/1974 | Mickelson |
| 3,842,014 | A | 10/1974 | Friend et al. |
| 3,864,451 | A | 2/1975 | Lee et al. |
| 3,948,754 | A | 4/1976 | McCollum et al. |
| 3,948,755 | A | 4/1976 | McCollum et al. |
| 3,960,706 | A | 6/1976 | McCollum et al. |
| 3,960,708 | A | 6/1976 | McCollum et al. |

(Continued)

FOREIGN PATENT DOCUMENTS

| | | |
|---|---|---|
| EP | 0341893 | 11/1989 |

(Continued)

OTHER PUBLICATIONS

Gary, J. H. (2007). Petroleum Refining Technology and Economics, 5th ed., CRC Press, 463 pgs (Office action cites p. 3).*

(Continued)

*Primary Examiner* — Walter D Griffin
*Assistant Examiner* — Brian McCaig
(74) *Attorney, Agent, or Firm* — Bracewell & Giuliani LLP

(57) ABSTRACT

The invention relates to a process for the desulfurization of a gasoline fraction with high recovery of olefins and reduced loss of Research Octane Number (RON). A petroleum fraction is contacted with hydrogen and a commercially available hydrodesulfurization catalyst under mild conditions with to remove a first portion of the sulfur present, and is then contacted with an adsorbent for the removal of additional sulfur.

26 Claims, 2 Drawing Sheets

U.S. PATENT DOCUMENTS 3,988,238 A 10/1976 McCollum et al.
3,989,618 A 11/1976 McCollum et al.
4,005,005 A 1/1977 McCollum et al.
4,082,695 A 4/1978 Rosinski et al.
4,151,068 A 4/1979 McCollum et al.
4,203,829 A 5/1980 Bertolacini
4,210,628 A 7/1980 Ninomiya et al.
4,325,926 A 4/1982 Blanton, Jr.
4,464,252 A 8/1984 Eberly, Jr.
4,483,761 A 11/1984 Paspek, Jr.
4,485,007 A 11/1984 Tam et al.
4,530,755 A * 7/1985 Ritchie et al. ..... 208/96
4,544,481 A 10/1985 Seiver et al.
4,594,141 A 6/1986 Paspek, Jr. et al.
4,719,000 A 1/1988 Beckberger
4,743,357 A 5/1988 Patel et al.
4,762,814 A 8/1988 Parrott et al.
4,813,370 A 3/1989 Capamaggio
4,818,370 A 4/1989 Gregoli et al.
4,840,725 A 6/1989 Paspek
4,908,122 A 3/1990 Frame et al.
5,087,350 A 2/1992 Paris-Marcano
5,096,567 A 3/1992 Paspek, Jr. et al.
5,167,797 A 12/1992 Ou
5,278,138 A 1/1994 Ott et al.
5,316,659 A 5/1994 Brons et al.
5,411,658 A 5/1995 Chawla et al.
5,421,854 A 6/1995 Kodas et al.
5,439,502 A 8/1995 Kodas et al.
5,466,363 A 11/1995 Audeh et al.
5,529,968 A 6/1996 Sudhakar et al.
5,538,930 A 7/1996 Sudhakar et al.
5,558,783 A 9/1996 McGuinness
5,597,476 A 1/1997 Hearn et al.
5,611,915 A 3/1997 Siskin et al.
5,616,165 A 4/1997 Glicksman et al.
5,676,822 A 10/1997 Sudhakar
5,695,632 A 12/1997 Brons et al.
5,837,640 A 11/1998 Sudhakar et al.
5,851,381 A 12/1998 Tanaka et al.
5,861,136 A 1/1999 Glicksman et al.
5,906,730 A 5/1999 Hatanaka et al.
5,928,497 A 7/1999 Iaccino
5,958,224 A 9/1999 Ho et al.
6,063,265 A 5/2000 Chiyoda et al.
6,103,393 A 8/2000 Kodas et al.
6,120,679 A 9/2000 Hatanaka et al.
6,153,123 A 11/2000 Hampden-Smith et al.
6,159,267 A 12/2000 Hampden-Smith et al.
6,197,718 B1 3/2001 Brignac et al.
6,228,254 B1 5/2001 Jossens et al.
6,248,230 B1 6/2001 Min et al.
6,277,271 B1 8/2001 Kocal
6,303,020 B1 10/2001 Podrebarac et al.
6,316,100 B1 11/2001 Kodas et al.
6,325,921 B1 12/2001 Andersen
6,334,948 B1 1/2002 Didillon et al.
6,488,840 B1 12/2002 Greaney et al.
6,500,219 B1 12/2002 Gunnerman
6,551,501 B1 4/2003 Whitehurst
6,579,444 B2 * 6/2003 Feimer et al. ..... 208/243
6,596,157 B2 7/2003 Gupta et al.
6,610,197 B2 8/2003 Stuntz et al.
6,623,627 B1 9/2003 Zhou
6,685,762 B1 2/2004 Brewster et al.
6,689,186 B1 2/2004 Hampden-Smith et al.
6,699,304 B1 3/2004 Hampden-Smith et al.
6,780,350 B1 8/2004 Kodas et al.
6,827,845 B2 12/2004 Gong et al.
6,881,325 B2 4/2005 Morris et al.
7,264,710 B2 9/2007 Hokari et al.
7,435,330 B2 10/2008 Hokari et al.
7,780,847 B2 8/2010 Choi
7,842,181 B2 11/2010 Choi
2003/0062163 A1 4/2003 Moulton et al.
2003/0217952 A1 11/2003 Brignac et al.
2004/0007506 A1 1/2004 Song et al.
2004/0024072 A1 2/2004 Lin et al.
2004/0118748 A1 6/2004 Lesemann et al.
2004/0178123 A1 9/2004 Podrebarac
2004/0188327 A1 9/2004 Groten
2005/0040078 A1 2/2005 Zinnen et al.
2005/0067323 A1 * 3/2005 Balko ..... 208/208 R
2005/0072137 A1 4/2005 Hokari et al.
2005/0075528 A1 4/2005 Burkhardt et al.
2005/0098478 A1 * 5/2005 Gupta et al. ..... 208/208 R
2005/0173297 A1 * 8/2005 Toida ..... 208/14
2005/0252831 A1 11/2005 Dysard et al.
2005/0284794 A1 12/2005 Davis et al.
2006/0011511 A1 1/2006 Hokari et al.
2006/0154814 A1 7/2006 Zanibelli et al.
2006/0163117 A1 7/2006 Hong
2007/0111319 A1 5/2007 Bastide et al.
2007/0234640 A1 10/2007 Jia et al.
2008/0099373 A1 5/2008 Hokari et al.
2008/0099374 A1 5/2008 He et al.
2008/0099375 A1 5/2008 Landau et al.
2008/0099376 A1 5/2008 He et al.
2008/0099377 A1 5/2008 He et al.
2008/0099378 A1 5/2008 He et al.
2009/0032436 A1 2/2009 Takahashi et al.
2009/0145808 A1 6/2009 Choi et al.
2009/0148374 A1 6/2009 Choi
2009/0230026 A1 9/2009 Choi et al.
2011/0024330 A1 2/2011 Choi

FOREIGN PATENT DOCUMENTS

EP 1454976 9/2004
EP 1577007 9/2005
EP 1923452 A1 5/2008
FR 2913235 9/2008
GB 1098698 A 1/1968
JP 07-265689 10/1995
JP 2000282063 10/2000
JP 2001019984 1/2001
JP 2001192676 7/2001
JP 2003049180 2/2003
JP 2003277770 10/2003
JP 2005015533 1/2005
WO WO9600269 1/1996
WO WO9967345 12/1999
WO 0179391 A1 10/2001
WO 02053684 A1 7/2002
WO WO2005005582 1/2005
WO WO2007015391 2/2007
WO WO2009070561 6/2009

OTHER PUBLICATIONS

Tim Old and Jeff Vander Lan, ConocoPhillips S ZorbTM Sulfur Removal Technology: A Proven Solution to the ULSG Challenge, ERTC 9th Annual Meeting, Prague, pp. 1-16, presented at the ERTC 9th Annual Meeting, Refining & Petrochemical, Apr. 27-29, 2005, Kuala Lumpur, Malaysia.

Arturo J. Hernandez-Maldonado and Ralph T. Yang, "Desulfurization of Transportation Fuels by Adsorption," Catalysis Reviews, vol. 46, No. 2, pp. 111-150, 2004.

Choi et al., "Impact of removal extent of nitrogen species in gas oil on its HDS performance: an efficient approach to its ultra deep desulfurization," Applied Catalysis B: Environmental 50 (2004) 9-16.

Sano et al., "Adsorptive removal of sulfur and nitrogen species from a straight run gas oil over activated carbons for its deep hydrodesulfurization," Applied Catalysis B: Environmental 49 (2004) 219-225.

Y. Sano, K.H. Choi, Y. Korai, I. Mochida, "Selection and Further Activation of Activated Carbons for Removal of Nitrogen Species in Gas Oil as a Pretreatment for Its Deep Hydrodesulfurization", Energy & Fuels (2004), pp. 644-651, vol. 18.

Y. Sano, K. Sugahara, K.H. Choi, Y. Korai, I. Mochida, "Two-step adsorption process for deep desulfurization of diesel oil", Fuel (2005), pp. 903-910, vol. 84, Elsevier Ltd.

Y. Sano, K. Choi, Y. Korai, I. Mochida, "Adsorptive removal of sulfur and nitrogen species from a straight run gas oil for its deep hydrodesulfurization", American Chemical Society, Fuel Chemistry Division Preprints (2003), vol. 48(1), pp. 138-139.
Y. Sano, K. Choi, Y. Korai, I. Mochida, "Effects of nitrogen and refractory sulfur species removal on the deep HDS of gas oil", Applied Catalysis B: Environmental (2004), vol. 53, pp. 169-174.
K. Choi, N. Kunisada, Y. Korai, I. Mochida, K. Nakano, "Facile ultra-deep desulfurization of gas oil through two-stage or -layer catalyst bed", Catalysis Today (2003), vol. 86, pp. 277-286.
Y. Sano, K. Choi, Y. Korai, I. Mochida, "Selection and Further Activation of Activated Carbons for Removal of Nitrogen Species in Gas Oil as a Pre-Treatment for Deep Desulfurization" American Chemical Society, Fuel Chemistry Division Preprints (2003), vol. 48(2), pp. 658-659.
Masaomi Amemiya, Yozo Korai, and Isao Mochida, "Catalyst Deactivation in Distillate Hydrotreating (Part 2) Raman Analysis of Carbon Deposited on Hydrotreating Catalyst for Vacuum Gas Oil," Journal of the Japan Petroleum Institute (2003), pp. 99-104, vol. 46, No. 2.
Edward Furimsky and Franklin E. Massoth, "Deactivation of hydroprocessing catalysts," Catalysis Today (1999), pp. 381-495, vol. 52.
Min "A Unique Way to Make Ultra Low Sulfur Diesel," Korean Journal of Chemical Engineering, vol. 19, No. 4 (2002) pp. 601-606, XP008084152.
Examiner's Report issued in EP Patent Application No. 08858377.8, dated Oct. 4, 2011 (6 pages).
Sara E. Skrabalak et al., "Porous MoS2 Synthesized by Ultrasonic Spray Pyrolysis" J. Am. Chem. Soc. 2005, 127, 9990-9991.
Ki-Hyouk Choi et al., "Preparation and Characterization on nano-sized CoMo/Al2O3 catalyst for hydrodesulfurization," Applied Catalysis A: General 260 (2004) 229-236.
K. Choi et al., "Preparation of CO2 Absorbent by Spray Pyrolysis," Chemistry Letters, vol. 32, No. 10 (2003), p. 924-925.
Y. Okamoto et al., "A study on the preparation of supported metal oxide catalysts using JRC-reference catalysts. I. Preparation of a molybdena-alumina catalyst. Part 1. Surface area of alumina," Applied Catalysis A: General 170 (1998), p. 315-328.
Messing et al., "Ceramic Powder Synthesis by Spray Pyrolysis," Journal of the American Ceramic Society, vol. 76, No. 11, pp. 2707-2726 (1993).
Okuyama et al., "Preparation of nanoparticles via spray route," Chemical Engineering Science, vol. 58, pp. 537-547 (2003).
Uematsu et al., "New application of spray reaction technique to the preparation of supported gold catalysts for environmental catalysis," Journal of Molecular Catalysis A: Chemical 182-183, pp. 209-214 (2002).
Mizushima et al., "Preparation of Silica-supported Nickel Catalyst by Fume Pyrolysis: Effects of Preparation Conditions of Precursory Solution on Porosity and Nickel Dispersion," Journal of the Japan Petroleum Institute, vol. 48, No. 2, pp. 90-96 (2005).
EP Examiner's Report issued in EP Patent Application No. 08857250.8, dated Jun. 28, 2011 (13 pages).
Gao et al., "Adsorption and reduction of NO2 over activated carbon at low temperature," Fuel Processing Technology 92, 2011, pp. 139-146, Elsevier B.V.
M. Te et al., "Oxidation reactivities of dibenzothiophenes in polyoxometalate/H2O2 and formic acid/H2O2 systems," Applied Catalysis A: General 219 (2001), p. 267-280.
P. De Filippis et al., "Oxidation Desulfurization: Oxidation Reactivity of Sulfur Compunds in Different Organic Matrixes," Energy & Fuels, vol. 17, No. 6 (2003), p. 1452-1455.
K. Yazu et al., "Oxidative Desulfurization of Diesel Oil with Hydrogen Peroxide in the Presence of Acid Catalyst in Diesel Oil/Acetic Acid Biphasic System," Chemistry Letters, vol. 33, No. 10 (2004), p. 1306-1307.
S. Otsuki et al., "Oxidative Desulfurization of Light Gas Oil and Vacuum Gas Oil by Oxidation and Solvent Extraction," Energy & Fuels, vol. 14, No. 6 (2000), p. 1232-1239.
J.T. Sampanthar et al., "A novel oxidative desulfurization process to remove refractory sulfur compounds from diesel fuel," Applied Catalysis B: Environmental 63 (2006), p. 85-93.
A. Chica et al., "Catalytic oxidative desulfurization (ODS) of diesel fuel on a continuous fixed-bed reactor," Journal of Catalysis, vol. 242 (2006), p. 299-308.
K. Yazu et al., "Immobilized Tungstophosphoric Acid-catalyzed Oxidative Desulfurization of Diesel Oil with Hydrogen Peroxide," Journal of Japan Petroleum Institute, vol. 46, No. 6 (2003), p. 379-382.
S. Murata et al., "A Novel Oxidative Desulfurization System for Diesel Fuels with Molecular Oxygen in the Presence of Cobalt Catalysts and Aldehydes," Energy & Fuels, vol. 18, No. 1 (2004), p. 116-121.
I. Mochida et al., "Kinetic study of the continuous removal of Sox on polyacrylonitrile-based activated carbon fibres," Fuel, vol. 76, No. 6 (1997), p. 533-536.
I. Mochida et al., "Removal of Sox and Nox over activated carbon fibers," Carbon, vol. 38 (2000), p. 227-239.
N. Shirahama et al., "Mechanistic study on adsorption and reduction of NO2 over activated carbon fibers," Carbon, vol. 40 (2002), p. 2605-2611.
E. Raymundo-Pinero et al., "Temperature programmed desorption study on the mechanism of SO2 oxidation by activated carbon and activated carbon fibres," Carbon, vol. 39 (2001) p. 231-242.
Mochida et al., "Adsorption and Adsorbed Species of SO2 during its Oxidative Removal over Pitch-Based Activated Carbon Fibers," Energy & Fuels, vol. 13, No. 2, 1999, pp. 369-373.
Zhou et al., "Deep Desulfurization of Diesel Fuels by Selective Adsorption with Activated Carbons," Prepr. Pap.-Am. Chem. Soc., Div. Pet, Chem, 2004, 49(3), pp. 329-332.
Kouzu et al., "Catalytic potential of carbon-supported Ni-Mo-sulfide for ultra-deep hydrodesulfurization of diesel fuel," Applied Catalysis A: General 265 (2004) 61-67.
Pawelec et al., "Carbon-supported tungsten and nickel catalysts for hydrodesulfurization and hydrogenation reactions," Applied Catalysis A: General 206 (2001) 295-307.
Farag et al., "Carbon versus alumina as a support for Co-Mo catalysts reactivity towards HDS of dibenzothiophenes and diesel fuel," Catalysis Today 50 (1999) 9-17.
Adschiri et al. "Hydrogenation through Partial Oxidation of Hydrocarbon in Supercritical Water", published in Int. J. of The Soc. of Mat. Eng. for Resources, vol. 7, No. 2, pp. 273-281, (1999).
Adschiri et al. "Catalytic Hydrodesulfurization of Dibenzothiophene through Partial Oxidation and a Water-Gas Shift Reaction in Supercritical Water", published in Ind. Eng. Chem. Res., vol. 37, pp. 2634-2638, (1998).
Sato et al. "Upgrading of asphalt with and without partial oxidation in supercritical water", published in Science Direct, Fuel, vol. 82, pp. 1231-1239 (2003).
Kishita, A. et al., "Upgrading of Bitumen by Hydrothermal Visbreaking in Supercritical Water with Alkai," Journal of the Japan Petroleum Institute, 2003, 215-221, 46 (4).
Choi et al., "Petroleum Upgrading and Desulfurizing Process," U.S. Appl. No. 13/009,062, filed Jan. 19, 2011.
Choi et al., "Removal of Sulfur Compounds from Petroleum Stream," U.S. Appl. No. 12/825,842, filed Jun. 29, 2010.
Examination Report issued in EP Patent Application No. 08855290.6, dated Dec. 22, 2011 (6 pages).

* cited by examiner

PROCESS TO PRODUCE LOW SULFUR CATALYTICALLY CRACKED GASOLINE WITHOUT SATURATION OF OLEFINIC COMPOUNDS

RELATED PATENT APPLICATION

This patent application claims priority to U.S. Provisional Patent Application Ser. No. 60/991,501, filed on Nov. 30, 2007, which is incorporated by reference in its entirety.

BACKGROUND OF THE INVENTION

1. Technical Field of the Invention

This invention relates generally to the field of hydroprocessing catalysts for treatment of heavy cat naphtha (HCN) to produce desirable low sulfur hydrocarbon products without causing saturation of olefinic products or the formation of hydrogen sulfide. Specifically, the invention relates to a process for the removal of sulfur from a partially desulfurized naphtha stream.

2. Description of the Prior Art

In the petroleum industry, it is common for light gas oils, particularly middle distillate petroleum fuels, to contain sulfur species. Increasing concerns regarding pollutants present in the atmosphere have led to a desire to decrease the sulfur content of fuels used in engines, as engines and vehicles utilizing fuels which contain sulfur can produce emissions of nitrogen oxide, sulfur oxide and particulate matter. Government regulations have become more stringent in recent years with respect to allowable levels of the potentially harmful emissions.

Gasoline fuel can generally be prepared by blending several petroleum fractions. Typical refineries blend catalytically cracked gasoline (CCG), coker gasoline, straight run naphtha, reformate, isomerate and alkylate to produce gasoline fuel having selected specifications. In blended gasoline, CCG produced from a fluidized catalytic cracker or coker is responsible for a substantial portion of the sulfur content in the resulting blend. Removal of sulfur contained in the CCG is an important step in meeting the regulations on sulfur content in gasoline fuel.

In the field of petroleum refining, CCG is a stock of high-octane number gasoline containing a certain amount of olefin components. CCG is a gasoline fraction that can be obtained by catalytically cracking a heavy petroleum fraction as a stock oil, such as vacuum gas oil, and recovering and distilling the catalytically cracked products. In addition, CCG is a primary blending stock of automotive gasoline.

While some stock oils have small sulfur content and may be subjected to catalytic cracking without treatment, stock oil generally has a relatively high content of sulfur compounds. When untreated stock oil having a high sulfur content is subjected to catalytic cracking, the resulting CCG will also have high sulfur content.

One prior art technique for the removal of sulfur compounds from petroleum fractions is by catalytic hydrodesulfurization, also known as HDS, a process in which a sulfur containing petroleum fraction is contacted with a solid catalyst in the presence of hydrogen gas at elevated temperature and pressure to effectuate the removal of the sulfur from the petroleum fraction. Exemplary hydrodesulfurization catalysts can include an alumina support, molybdenum sulfide, cobalt sulfide and/or nickel sulfide. Catalytic activity of the hydrodesulfurization catalyst can be increased with the addition of a third or fourth element, such as for example, boron or phosphorous. However, removal of sulfur under relatively severe conditions requires a highly active and highly selective catalyst for use at high reaction temperatures and pressures.

Catalytic desulfurization generally takes place at elevated temperature and pressure in the presence of hydrogen, and may often result in the hydrogenation of other compounds, such as for example, olefin compounds, which may be present in the petroleum fraction which is being desulfurized. Hydrogenation of olefin products is generally undesirable as the olefins are partially responsible for providing higher octane ratings of the feedstock. Thus, hydrogenation of olefin compounds may result in a decreased overall octane rating for the feedstock. If there is significant loss of octane rating during the hydrodesulfurization of the hydrocarbon stream, because of saturation of olefin compounds, the octane loss must be compensated for by blending substantial amounts of reformate, isomerate and alkylate into the gasoline fuel. The blending of additional compounds to increase the octane rating is expensive and detrimental to the overall economy of the refining process.

Additionally, catalytic hydrodesulfurization can result in the formation of hydrogen sulfide as a byproduct. Hydrogen sulfide produced in this manner can recombine with species present in the hydrocarbon feed, and create additional or other sulfur containing species. Olefins are one exemplary species prone to recombination with hydrogen sulfide to generate organic sulfides and thiols. This reformation to produce organic sulfides and thiols can limit the total attainable sulfur content which may be achieved by conventional catalytic desulfurization.

Because HCN has a higher final boiling point than LCN and contains a larger amount of sulfur containing compounds (in particular benzothiophene), more severe hydrotreating conditions are typically required to attain a low sulfur content in the final product. The severe hydrotreating conditions can result in significant saturation of olefin compounds, even though the number of olefin compounds present in the HCN is relatively low as compared with the LCN. This results in a loss of octane number (RON).

Some conventional sulfur removal processes attempt to overcome the problem of octane number reduction by making use of the non-uniform distribution of olefins and sulfur-containing species across the naphtha boiling range. Typically in naphtha, olefins are most concentrated and the sulfur concentration is lowest in the fraction which boils between about 30° C. and 100° C., i.e., the light cat naphtha fraction. Sulfur species are most concentrated and the olefin concentration is relatively low in the heavy cat naphtha boiling range, typically between about 90° C. to about 230° C. Generally, in the HCN fraction, a large amount of sulfur species exist at higher distillation temperatures. Specifically, a high number of sulfur containing species exist in the portion of the HCN fraction boiling between approximately 150° C. and approximately 230° C. Sulfur species in the LCN fraction may be removed by caustic extraction without undesirable olefin saturation, while the HCN fractions generally require hydrotreating to remove the sulfur.

Because of the relatively high content of sulfur species in the higher boiling fraction of HCN, the industry currently only considers the HCN fraction between about 60° C. and about 160° C., excluding the portion of the HCN fraction having a boiling point between about 160° C. and about 230° C. because of the high sulfur content.

Therefore, improved products and methods for the removal of sulfur compounds from heavy cat naphtha fractions are needed which minimize both the saturation of olefins and the formation of hydrogen sulfide byproducts.

SUMMARY OF THE INVENTION

A hydrodesulfurization catalyst composition, a method for preparing a hydrodesulfurization catalyst and a method of removing sulfur compounds from petroleum feedstock is provided. More specifically, a method for the removal of sulfur compounds from overcut heavy cat naphtha (HCN).

In one aspect, a method for a producing gasoline fraction having reduced sulfur content is provided. The method includes the steps of contacting an overcut heavy cat naphtha fraction with a hydrodesulfurization catalyst in the presence of hydrogen gas to remove at least a portion of the sulfur present in the overcut heavy cat naphtha fraction and produce a low sulfur heavy cat naphtha effluent; contacting the low sulfur heavy cat naphtha effluent with a solid adsorbent that includes a solid support having metal species appended to the surface at a temperature of between about 0° C. and about 100° C., and recovering a product stream having a reduced sulfur content.

In other embodiments the product stream has a sulfur content of less than about 10 ppm. In certain embodiments the step of contacting the overcut heavy cat naphtha with the hydrotreating catalyst removes up to about 95% of the sulfur present. In certain other embodiments the step of contacting the hydrotreated overcut heavy cat naphtha with the adsorbent can remove up to about 95% of the remaining sulfur.

In another aspect, a process for producing a gasoline fraction having reduced sulfur content is provided. The process includes the steps of separating a high boiling overcut heavy cat naphtha (HCN) fraction from a full boiling point range catalytically cracking gasoline (CCG), contacting the HCN fraction with a catalyst in the presence of hydrogen to remove a portion of the sulfur compounds and produce a hydrodesulfurization product, removing hydrogen sulfide and hydrogen gases from the hydrodesulfurization product to produce a stripper effluent, contacting the stripper effluent with a solid adsorbent to remove sulfur compounds and produce a gasoline fraction having reduced sulfur content, and wherein the loss of Research Octane Number of the overcut heavy cat naphtha is less than about 2.

BRIEF DESCRIPTION OF THE DRAWINGS

So that the manner in which the features, advantages and objects of the invention, as well as others that will become apparent, may be understood in more detail, more particular description of the invention briefly summarized above may be had by reference to the embodiment thereof which is illustrated in the appended drawings, which form a part of this specification. It is to be noted, however, that the drawings illustrate only a preferred embodiment of the invention and is therefore not to be considered limiting of the invention's scope as it may admit to other equally effective embodiments.

DETAILED DESCRIPTION OF THE INVENTION

Figure 1:
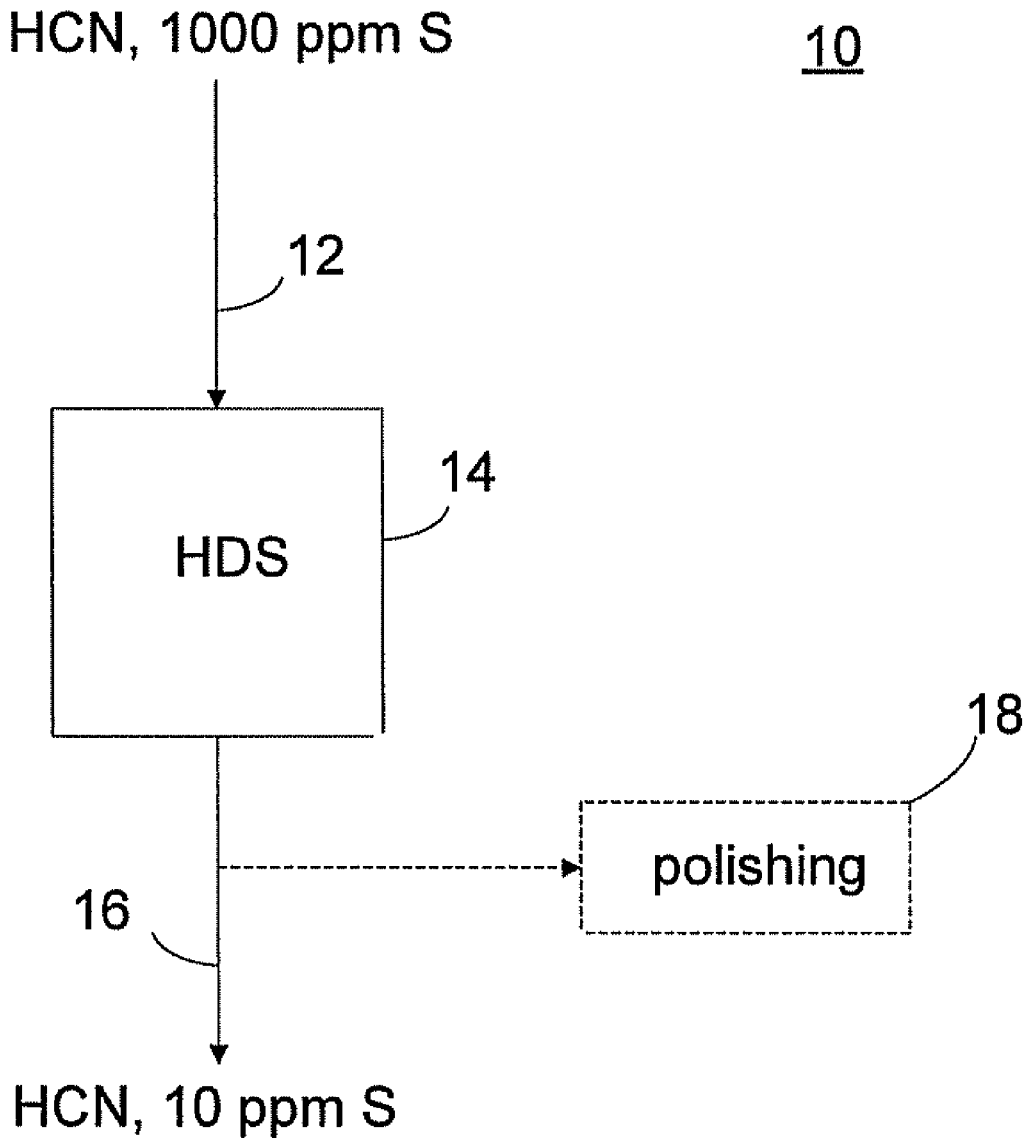
FIG. 1 depicts a prior art apparatus for the desulfurization of a petroleum distillate.

In one aspect, a method is provided for the removal of sulfur from a hydrocarbon feedstock which is high in sulfur concentration with minimal saturation of olefins. Specifically, the method and catalyst composition are useful for removal of sulfur from overcut heavy cat naphtha (HCN) prepared from catalytically cracked gasoline (CCG). The method and catalyst compositions disclosed are useful for minimizing olefin saturation and minimizing production of hydrogen sulfide. In particular, the catalyst composition can be useful in the removal of sulfur from middle distillates produced at distillation temperatures typically ranging from about 90° C. to about 230° C.

As used herein, overcut heavy cat naphtha (or overcut HCN) refers to a heavy cat naphtha fraction prepared from CCG having a distillation temperature of between about 90° C. and about 230° C. The overcut HCN is distinguished from the portion of the HCN fraction typically used in industry today having a boiling point between about 60° C. and about 160° C. As noted previously, in industry today, the HCN fraction having a boiling point between about 160° C. and about 230° C. is typically not treated because of the high sulfur content. Thus, the present invention addresses the removal of sulfur from the entire HCN fraction, including the portion having a boiling point between about 160° C. and about 230° C.

Whole crude oil typically undergoes equilibrium separation treatments to separate light components from heavier components. The lighter fraction, such as gas oil, is typically processed and hydrotreated to create diesel, while the heavy fraction, such as vacuum gas oil (VGO), undergoes catalytic cracking to produce gasoline.

Catalytically cracked gasoline produced from a fluidized catalytic cracker (FCC) or coker can be responsible for a substantial portion of the sulfur present in gasoline. Thus, given the rigorous current standards for allowable sulfur content in fuels, as previously discussed, the removal of sulfur containing species is of increasing importance.

The desulfurization process disclosed herein includes at least two steps. In the first step, the overcut HCN stream that includes sulfur is treated in the hydrodesulfurization process under mild conditions to remove a majority of the sulfur present, while at the same time minimizing the hydrogenation of olefins. The effluent from the hydrodesulfurization process can then be contacted with the adsorbent to further remove sulfur from the hydrocarbon stream.

Hydrodesulfurization

Hydrodesulfurization of an overcut HCN feedstream that contains sulfur can be performed using known hydrotreating catalysts and under mild conditions to partially remove sulfur species. The hydrodesulfurization step can be responsible for the removal of at least about 80% of the sulfur present, and in certain embodiments, can be responsible for the removal of about 90% of the sulfur present. Performing the desulfurization under mild conditions generally results in increased catalyst life time and reduced production of undesired byproducts. In addition, desulfurizing under mild conditions generally means performing the desulfurization at reduced temperature and pressure, which can be beneficial from an economic standpoint as well.

Generally, an overcut HCN feed stream having a boiling point range of between about 60° C. and about 230° C. is supplied to a hydrotreating reactor which includes a conventional commercially available hydrotreating catalyst. A variety of hydrodesulfurization reactors can be employed, including for example, fixed bed reactors, trickle bed reactors, slurry bed reactors, and the like.

The desulfurization catalyst can include any known support material, including but not limited to, silica, alumina, silica-alumina, silicon dioxide, titanium oxide, activated carbon, zeolite, synthetic and natural clays, spent catalyst, and the like, and combinations thereof.

In certain embodiments, the desulfurization catalyst can include a metal selected from Group VIB of the periodic table, including chromium, molybdenum or tungsten. In certain other embodiments, the desulfurization can include a metal selected from Group VIIIB of the periodic table, including iron, ruthenium, osmium, cobalt, rhodium, iridium, nickel, palladium and platinum. Preferably, the metal is selected from chromium, molybdenum, tungsten, cobalt, nickel, and mixtures thereof. Cobalt-molybdenum, nickel-molybdenum and nickel-cobalt-molybdenum are preferred metal compositions for use in the hydrotreating catalyst. These metals can be in the form of a metal, an oxide, a sulfide or a mixture thereof on the support material. The metal can be supported on the support material by a known method, such as for example, impregnation or co-precipitation.

While specialized catalysts that have been designed for deep hydrodesulfurization without significant loss of olefin species can be employed in the present process, such catalysts are not required.

In an embodiment, the desulfurization reaction can be conducted at a temperature of between about 250° C. and about 450° C., and preferably between about 270° C. and about 350° C. The operating pressure can be between about 200 and about 800 psig, preferably between approximately about 250 and about 350 psig. The liquid hourly space velocity (LHSV ($h^{-1}$)) can be between about 2 and about 10, and preferably can be between about 5 and about 7. The volume of hydrogen to oil (L/L) can be between about 90 and about 150, and is preferably between about 100 and about 130. It is understood that one of skill in the art can alter the operating parameters listed above based upon the hydrotreating catalyst used, the sulfur content of the feed, and/or the desired sulfur content of the product stream. It is also understood that the exact hydrodesulfurization conditions employed can be less severe than those normally employed in instances wherein the hydrodesulfurization step is responsible for the removal of approximately 95% or more of the sulfur present in the feedstock. This minimizes undesirable side effects.

Adsorbent

The effluent from the hydrotreating step can be supplied to a bed which includes an adsorbent material, for removal of a substantial portion the sulfur species remaining in the effluent.

The adsorbent can include a support material. Exemplary support materials include silica, alumina, silica-alumina, zeolite, synthetic clay, natural clay, activated carbon, activated charcoal, activated carbon fiber, carbon fabric, carbon honeycomb, alumina-carbon composite, silica-carbon composite, carbon black, and the like, and combinations thereof. One preferred support material is activated carbon.

The adsorbent particles can have a diameter of about 2 mm. In certain embodiments, the adsorbent particles preferably have a diameter of less than approximately about 20 mm. In the case of activated carbon fiber, the diameter of the fiber can be less than about 0.1 mm. In certain embodiments, the diameter of the activated carbon fiber can have a diameter of approximately 5 μm. The adsorbent can have an effective surface area of approximately 200 $m^2/g$ or greater. Preferably the effective surface area is approximately 500 $m^2/g$ or greater. More preferably, the effective surface area is approximately 1000 $m^2/g$ or greater.

In certain embodiments, the adsorbent particles can include metal components selected from the Group VIB and Group VIIIB elements of the periodic table. In certain embodiments, the adsorbent can include a Group VIB metal selected from chromium, molybdenum or tungsten, or combinations thereof. In other embodiments, the adsorbent can include a Group VIIIB metal component selected from iron, ruthenium, osmium, cobalt, rhodium, iridium, nickel, palladium and platinum. In yet other embodiments the adsorbent can include at least one metal selected from the Group VIB metals listed above and at least one metal selected from the Group VIIIB metals listed above. In certain preferred embodiments, the adsorbent includes molybdenum and at least one of nickel or cobalt.

The adsorbent can also include other elements which are known promoters. Exemplary known promoters include, but are not limited to, boron and phosphorous.

In certain embodiments, the adsorbent can include a metal selected from Group IB and Group IIB of the periodic table, including copper and zinc. The Group IB metals are believed to assist in the trapping of sulfur molecules. In certain embodiments, the adsorbent can include copper.

The adsorbent can optionally be pre-treated by chemical, thermal or physical means prior to contact with the sulfur containing overcut HCN stream.

In one embodiment, the adsorbent can be pretreated by pyrolysis. Specifically, the adsorbent can be heated to a temperature greater than about 600° C. in an argon atmosphere for a period of approximately 3 hours. In certain embodiments, the adsorbent is pretreated by heating to a temperature greater than about 800° C. in an argon atmosphere for a period of approximately 2 hours. In certain preferred embodiments, the adsorbent is pretreated by heating to a temperature between about 700° C. and about 850° C. in an argon atmosphere for a period of approximately 2.5 hours. The thermal pretreatment can remove species that are bound to the surface of the adsorbent particles, such as for example, carbon monoxide, carbon dioxide and water.

In another embodiment, the adsorbent can be pretreated by heating to between about 400° C. and about 600° C. in a nitrogen atmosphere containing up to approximately 1% by volume oxygen for a period of approximately 1 hour. In another embodiment, the adsorbent can be pretreated by heating to approximately 500° C. in a nitrogen atmosphere containing up to approximately 0.5% by volume oxygen for a period of approximately 90 minutes. Without being bound to a specific theory, this process is believed to generate carbonyl type surface species or other active surface species and may create additional pores by a surface combustion effect.

In another embodiment, the adsorbent can be pretreated by heating to between about 300° C. and about 400° C. in a nitrogen atmosphere, and exposing the adsorbent to up to approximately 1% by volume to a mixture of oxygen and sulfur dioxide, nitrogen oxide or nitrogen dioxide. The sulfur and nitrogen species are generally easily attached to the surface of the adsorbent. This process can be used to prepare a surface on the adsorbent that is rich in $SO_3$ and $NO_2$ species, which can then be used for oxidative desulfurization of the overcut HCN effluent from the hydrotreating step.

Regeneration of the Adsorbent

Regeneration of the adsorbent can be achieved by washing the adsorbent with common organic solvents to remove adsorbed sulfur species, followed by drying. Exemplary organic solvents useful for the regeneration of the adsorbent can include, but are not limited to, benzene, toluene, xylene, straight run naphtha, ethanol, isopropanol, n-butanol, isobutanol, n-pentanol, isopentanol, ketones, and mixtures thereof. However, it is understood that the list of organic solvents provided is merely exemplary and that a variety of different solvents may be employed in the regeneration of the adsorbent species.

The adsorbent can be washed with about 5 or more equivalent volumes of organic solvent to remove the adsorbed sulfur. In certain embodiments, the adsorbent can be washed with between about 7 and about 15 equivalent volumes of organic solvent. In certain embodiments, at least approximately 10 equivalent volumes of organic solvent can be used to wash the adsorbent. The organic solvent wash can be sampled after the washing step to determine whether the adsorbed sulfur has been sufficiently removed from the adsorbent. Such sampling may be integrated and automated, as is known in the art. The organic solvent can be treated to remove sulfur containing species and recycled to the regeneration step.

The washed adsorbent particles can be dried at a temperature between about 10° C. and about 150° C. In an exemplary embodiment, the washed adsorbent particles can be dried at a temperature of between about 30° C. and about 70° C. Additionally, the adsorbent can be regenerated under a vacuum pressure of between about 1 mmHg and about 300 mmHg. During regeneration, the adsorbent particles can be subjected to flowing gas. Exemplary gases include air, nitrogen, helium, argon, and the like. In one preferred embodiment, the flowing gas is an inert gas. In another preferred embodiment, the flowing gas can be nitrogen or air.

Desulfurization Procedure

Prior art desulfurization procedures generally employ a single step hydrodesulfurization process, as shown in FIG. 1. As shown, an HCN fraction containing approximately 1000 ppm sulfur is supplied to a commercial hydrodesulfurization apparatus, which is operated at conditions operable to achieve a product stream having approximately 10 ppm sulfur (i.e., removal of approximately 99% of the sulfur). While specific operating conditions can vary, it is generally accepted that operating a hydrodesulfurization apparatus at the conditions operable to remove the substantial majority of the sulfur present will require relatively high temperature and pressure, and will likely result in the saturation of some olefin species. In certain embodiments, the hydrodesulfurization reactor can be operated at conditions operable for the removal of at least about 90% of the sulfur species. In another embodiment, the reactor can be operated at conditions operable for the removal of at least about 95% of the sulfur species. As noted previously, saturation of olefins in the HCN stream can result in a loss of octane number. A loss of RON (research octane number) of at least about 2-3 is common in the hydrodesulfurization of an HCN feed wherein the hydrodesulfurization reactor is operated at conditions operable for the removal of sulfur to achieve a sulfur content of less than about 25 ppm. As noted previously, a loss of RON can require the addition of octane boosting additives, to achieve the desired properties of the resulting gasoline.

Additionally, as shown in FIG. 1, the prior art methods of desulfurization can require frequent sampling of the desulfurized product stream to ensure adequate removal of sulfur. When the product stream is below the desired specification, i.e., when the sulfur content of the product stream is higher than the minimum desired specification, the stream can be retreated to decrease the sulfur content in the product stream. Exemplary methods can include resupplying the product stream to an HDS unit for additional removal of sulfur, or blending of the off-specification HCN sample with a volume of HCN having much lower sulfur content than off-specification HCN.

Figure 2:
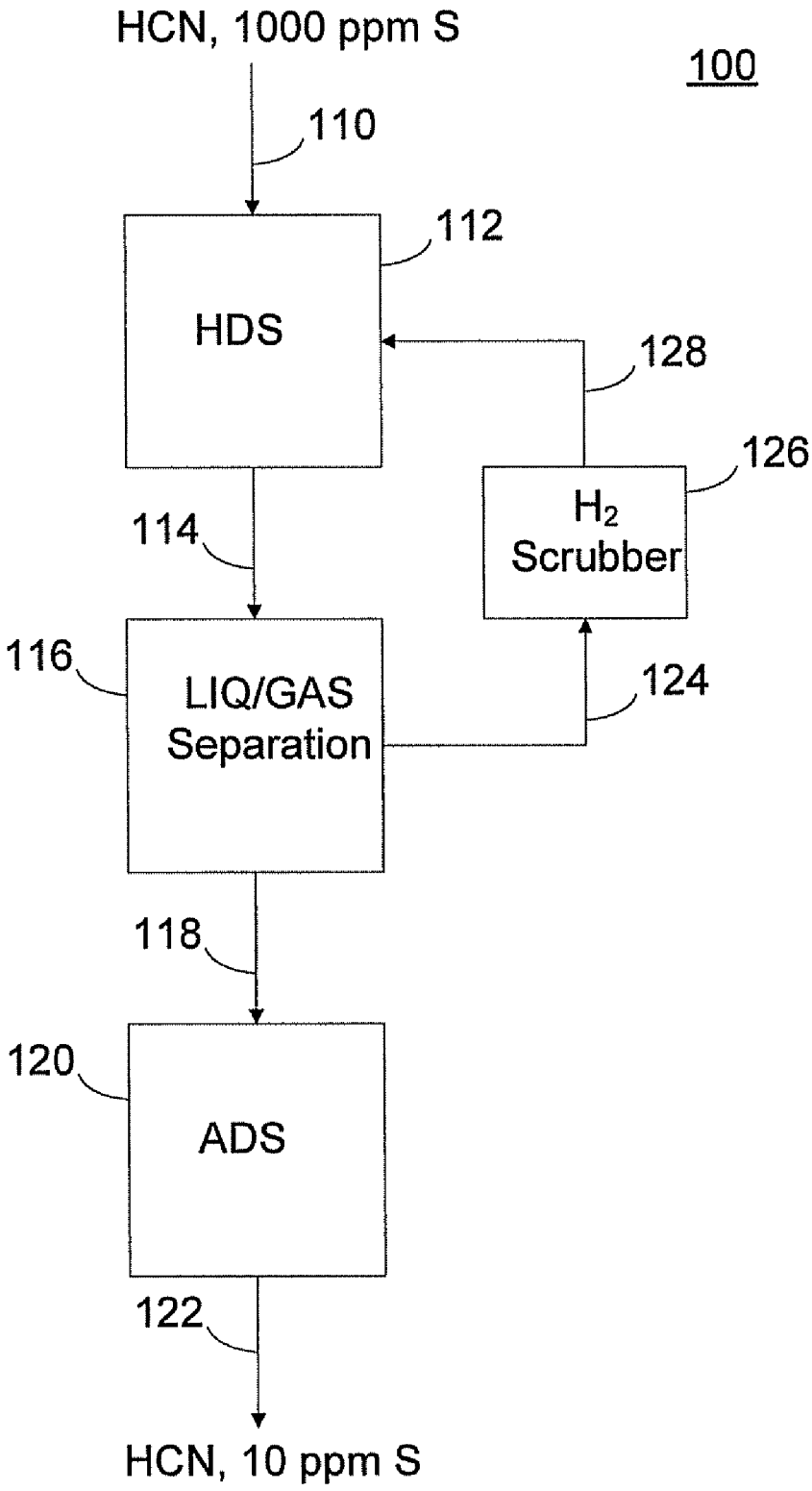
FIG. 2 depicts one embodiment of an apparatus for the desulfurization of a petroleum distillate.

As shown in FIG. 2, a method is provided for the desulfurization of an HCN stream having an initial sulfur content of approximately 1000 ppm. The HCN stream is supplied via line 110 to conventional hydrodesulfurization unit 112. Hydrodesulfurization unit 112 can include a catalytic reactor for the removal of sulfur from the HCN stream, such as for example a fixed bed hydrotreating reactor.

The catalytic hydrotreating reactor can include a commercially available hydrodesulfurization catalyst, such as for example, a cobalt-molybdenum or a nickel-molybdenum catalyst on an alumina support material. The catalytic reactor can be operated at relatively mild conditions to remove a major portion of the sulfur contained in the HCN stream. In certain embodiments, the catalytic reactor can be operated to produce effluent 114, which includes between about 50 and about 200 ppm sulfur. More preferably, the catalytic reactor is operated to produce effluent 114 which includes approximately 100 ppm sulfur. In certain embodiments, hydrodesulfurization unit 112 removes at least about 85% of the sulfur present. In certain other embodiments, hydrodesulfurization unit 112 removes at least about 90% of the sulfur present.

Effluent 114 from hydrodesulfurization unit 112 can be supplied to liquid/gas separation unit 116 to remove the hydrogen and hydrogen sulfide gases. The liquid portion which includes a partially desulfurized HCN fraction is supplied from separation unit 116 via line 118 to adsorbent desulfurization unit 120 for the removal of the remainder of the sulfur from the HCN stream.

The hydrogen and hydrogen sulfide gases separated from the partially desulfurized HCN fraction can be supplied from separation unit 116 via line 124 to scrubber 126 for removal of hydrogen sulfide. The hydrogen gas can then be supplied from scrubber 126 via line 128 to hydrodesulfurization unit 112, or can optionally be supplied to other plant operations.

The adsorbent desulfurization unit can include an adsorbent as described herein. Preferable adsorbents can include copper and may optionally include zinc. In some embodiments, the HCN feed can be contacted with the adsorbent in the absence of hydrogen gas. In other embodiments, the HCN feed can be contacted with the adsorbent under atmospheric pressure in the absence of oxygen.

The process can employ multiple adsorption beds which can be fluidicly coupled to allow the treatment process to continue while spent adsorbent is regenerated. In certain embodiments, a plurality of adsorption beds can be fluidicly coupled to an organic solvent source, wherein the adsorption beds can include valves or other isolation means to allow for one or more adsorption beds to be placed "off line", allowing for regeneration of the adsorbent.

Partially desulfurized HCN stream 118 preferably contains less than about 200 ppm sulfur. Even more preferably, partially desulfurized stream 118 contains between about 50 and about 150 ppm sulfur. While the adsorbent is capable of removing sulfur from a feed that contains greater than about 200 ppm sulfur, this requires more frequent regeneration of the adsorbent bed, thus requiring the use and disposal of increased amounts of organic solvents.

The adsorbent can be contacted with hydrocarbon stream which contains sulfur at a temperature of between about 0° C. and about 100° C. In certain embodiments, the hydrocarbon stream is contacted with the adsorbent at a temperature of between about 10° C. and about 50° C.

While FIG. 2 shows the adsorption bed positioned downstream from the hydrodesulfurization reactor, it is understood that the adsorption bed can similarly be positioned upstream of the reactor. In addition, it is understood that in certain embodiments, an adsorption bed can be positioned both upstream and downstream from the hydrodesulfurization reactor.

EXAMPLE

A full range cat naphtha (FRCN) feedstock was distilled to produce an overcut heavy cat naphtha (HCN) fraction having a boiling point range between approximately 95° C. and 230° C. This can be referred to as overcutting because the HCN fraction has a final boiling point that is higher as compared to the conventional final boiling point of HCN. Thus, the overcut HCN contains significant amounts of sulfur from the full range CCG, and significantly higher amounts of sulfur than a conventional HCN fraction. Typically, sulfur species are most prevalent in the cut in the fraction having a boiling point range from about 160° C. to 230° C. By overcutting in the distillation section, the majority of the sulfur species have been directed into the overcut heavy cat naphtha fraction. Properties of the initial FRCN feedstock and the separated HCN fraction are provided in Table 1. As shown in Table 1, the HCN fraction has an increased concentration of aromatics, when compared to the initial FRCN feedstock. Finally, it is noted that the concentration of sulfur and nitrogen are greater in HCN than in the initial FRCN feedstock.

TABLE 1

| | FRCN | HCN |
|---|---|---|
| Total Sulfur (ppm S) | 2466.7 | 4223 |
| Total Nitrogen (ppm N) | 19.17 | 33.62 |
| Composition, wt % (ASTM-D5134) | | |
| Aromatics | 22.20 | 42.22 |
| I-Paraffins | 27.30 | 23.25 |
| Napthenes | 14.22 | 13.46 |
| n-Olefins | 10.66 | 4.34 |
| I-Olefins | 11.97 | 3.57 |
| Cyclic-Olefins | 1.47 | 0.31 |
| Total Olefins | 25.46 | 9.89 |
| Paraffins | 5.19 | 5.36 |
| Unidentified | 3.97 | 5.83 |
| Distillation Temperature, ° C. (ASTM D2887) | | |
| 5% | 31.1° C. | 94.6° C. |
| 10% | 35.2 | 103.4 |
| 30% | 68.2 | 128.8 |
| 50% | 104.4 | 155.1 |
| 70% | 147.3 | 184.2 |
| 90% | 204.1 | 220.2 |
| 95% | 222.6 | 233.7 |

The HCN fraction described in Table 1 above was hydrotreated with a conventional hydrodesulfurization catalyst, which included cobalt and molybdenum on an alumina support, in the presence of hydrogen. A reactor was charged with 10 mL of a pre-sulfided $CoMo/Al_2O_3$ catalyst. The $CoMo/Al_2O_3$ catalyst was pre-sulfided at 320° C. for approximately 12 hours with straight run naphtha spiked with dimethyldisulfide to produce a catalyst having 2.5 wt % sulfur. Operating conditions for the hydrotreating of two HCN samples are summarized in Table 2. In the Run 12, the hydrodesulfurization was conducted at approximately 300° C., whereas in Run 13 the hydrodesulfurization was conducted at approximately 340° C.

TABLE 2

| | Run 12 | Run 13 |
|---|---|---|
| Press. (psig) | 300.0 | 300.0 |
| Temp. (° C.) | 300 | 339 |
| LHSV ($h^{-1}$) | 6.1 | 6.2 |
| $H_2$/Oil (L/L) | 117 | 116 |
| Liquid yield (vol %) | 99.1 | 98.8 |

The desulfurized HCN fractions from Runs 12 and 13 were collected and analyzed, as shown in Table 3. As shown in Table 3, performing the hydrodesulfurization step at higher temperatures (i.e., 339° C. in Run 13 versus 300° C. in Run 12), has a drastic effect on amount of sulfur removed from the HCN fraction. Total sulfur content of the of the treated HCN for Run 13 was reduced from approximately 4200 ppm in the HCN feed to approximately 162 ppm; a reduction of approximately 96% of the sulfur. In contrast, total sulfur content of the treated HCN for Run 12 was reduced from approximately 4200 ppm in the HCN feed to approximately 857 ppm; a reduction of approximately 80%. Similarly, greater amounts of nitrogen were removed at higher temperature as the Run 13 conditions resulted in the removal of approximately 84% of the nitrogen content, and the lower temperature conditions of Run 12 resulted in the removal of approximately 80% of the nitrogen content. Additionally, operating the hydrodesulfurization at a higher temperature resulted in a decrease in olefin content of approximately 18.5% and an increase in paraffin content of approximately 10.8%. The results in Table 3 demonstrate increased sulfur removal at more severe operating condition, and similarly show the expected reduction in olefin content.

TABLE 3

| | Partially Desulfurized HCN from Run 12 | Partially Desulfurized HCN from Run 13 |
|---|---|---|
| Total Sulfur (ppm S) | 856.58 | 161.8 |
| Total Nitrogen (ppm N) | 6.65 | 5.12 |
| Composition, wt % (ASTM D-5134) | | |
| Aromatics | 41.626 | 41.598 |
| I-Paraffins | 24.783 | 25.668 |
| Napthenes | 13.904 | 13.812 |
| Olefins | 8.288 | 6.752 |
| Paraffins | 6.526 | 7.230 |
| Unidentified | 4.873 | 4.940 |
| Distillation(ASTM D2887) | | |
| 5% | 96.6 | 94.8 |
| 10% | 105.6 | 105.8 |
| 30% | 134.4 | 134.9 |
| 50% | 159.0 | 159.9 |
| 70% | 184.0 | 184.2 |
| 90% | 216.7 | 216.6 |
| 95% | 232.5 | 232.2 |

The partially desulfurized HCN fractions from Runs 12 and 13 were then introduced into a stainless steel tube of approximately 50 mm length and 8 mm diameter, which were charged with 0.875 gram and 0.892 gram, respectively, of activated carbon having specific surface area of 1,673 $m^2$/gram measured by BET method, at room temperature. Flow rate of liquid product was 0.2 mL/min. Table 4 and Table 5 summarizes the properties of the product streams from Runs 12 and 13, respectively.

As shown in Table 4, adsorptive desulfurization of the Run 12 product stream resulted in the removal of approximately 60% of the sulfur present in Run 12 product stream. Table 5 demonstrates the removal of approximately 40% of the sulfur present in the Run 13 product stream. Additionally, as noted in Tables 4 and 5, olefin content was not reduced as a result of the adsorptive desulfurization process.

TABLE 4

| | Effluent from Liquid Product from Run 12 | Effluent from Liquid Product from Run 12 |
|---|---|---|
| Volume introduced to the adsorption bed | 0 mL to 3 mL | 3 mL to 6 mL |

TABLE 4-continued

| | Effluent from Liquid Product from Run 12 | Effluent from Liquid Product from Run 12 |
|---|---|---|
| Total Sulfur (ppm S) | 348.37 | 882.58 |
| Relative Sulfur Content (%)*1 | 40.7% | 103.0% |
| Total Nitrogen (ppm N) | 1.66 | 4.44 |
| Relative Nitrogen Content (%)*1 | 25.0% | 66.8% |
| Olefins | 9.086 | 8.260 |
| Relative Olefins Content (%)*1 | 109.6% | 99.7% |

TABLE 5

| | Effluent from Liquid Product from Run 13 | Effluent from Liquid Product from Run 13 |
|---|---|---|
| Volume introduced to the adsorption bed | 0 mL to 3 mL | 3 mL to 6 mL |
| Total Sulfur (ppm S) | 95.71 | 142.02 |
| Relative Sulfur Content(%)*1 | 59.2% | 87.8% |
| Total Nitrogen (ppm N) | 1.31 | 2.6 |
| Relative Nitrogen Content(%)*1 | 25.6% | 50.8% |
| Olefins | 7.416 | 7.060 |
| Relative Olefins Content(%)*1 | 109.8% | 104.6% |

*1: Relative contents to those of Liquid Products.

It is understood that while the Examples presented are directed to the desulfurization of HCN, the methods described can be applied to the treatment of any hydrocarbon based feedstock. However, it is recognized that the methods described herein can be most advantageously applied to hydrocarbon feedstocks that have high sulfur content and relatively high olefin content.

As used herein, the terms about and approximately should be interpreted to include any values which are within 5% of the recited value. In addition, when the terms about or approximately are used in conjunction with a range of values, the terms should be interpreted to apply to both the low end and high end values of that range.

While the invention has been shown or described in only some of its embodiments, it should be apparent to those skilled in the art that it is not so limited, but is susceptible to various changes without departing from the scope of the invention.

We claim:

1. A method for producing gasoline fraction having a reduced sulfur content comprising:

contacting an overcut heavy cat naphtha fraction with a hydrotreating catalyst in the presence of hydrogen gas to remove at least a portion of the sulfur present in the overcut heavy cat naphtha fraction and produce a low sulfur hydrotreated heavy cat naphtha effluent;

contacting the low sulfur hydrotreated heavy cat naphtha effluent with a solid adsorbent at a temperature of between about 0° C. and 100° C., wherein the solid adsorbent comprises a solid support, wherein the adsorbent is pretreated by pyrolyzing to a temperature of at least about 600° C. in an inert atmosphere; and recovering a product stream having reduced sulfur content.

2. The method of claim 1 wherein the product stream has a sulfur content of less than 20 ppm.

3. The method of claim 1 wherein the product stream has a sulfur content of less than 10 ppm.

4. The method of claim 1 wherein contacting the overcut heavy cat naphtha with the hydrotreating catalyst removes up to 95% of the sulfur present and contacting the low sulfur hydrotreated heavy cat naphtha effluent with the adsorbent removes up to 95% of the remaining sulfur.

5. The method of claim 1 further comprising supplying the low sulfur hydrotreated heavy cat naphtha effluent to a liquid-gas separator to remove hydrogen and hydrogen sulfide from the effluent.

6. The method of claim 1 wherein the hydrotreating catalyst comprises:

a catalyst support selected from alumina, silica, silica-alumina, zeolite, synthetic clay, natural clay, activated carbon, activated carbon fiber and carbon black;

at least one metal selected from chromium, molybdenum, tungsten, nickel and cobalt; and optionally including one or more of the elements selected from boron, nitrogen, fluorine, chlorine, phosphorous, potassium, magnesium, sodium, rubidium, calcium, lithium, strontium and barium.

7. The method of claim 1 wherein the adsorbent comprises metal species appended to a surface thereof.

8. The method of claim 7 wherein at least a portion of the metal species are present as sulfides.

9. The method of claim 1 wherein the adsorbent comprises at least one Group IB metal and at least one Group IIB metal.

10. The method of claim 9 wherein the Group IB metal is selected from copper and the Group IIB metal is selected from zinc.

11. The method of claim 1 wherein the adsorbent is an activated carbon having a surface area greater than about 500 $m^2/g$.

12. The method of claim. 1 wherein the overcut heavy cat naphtha fraction is contacted with the hydrotreating catalyst at a temperature of between 300° C. and 350° C. and a pressures of between about 0.5 MPa and 5 MPa.

13. The method of claim 1 further comprising regenerating the adsorbent; wherein regeneration of the adsorbent comprises washing the adsorbent with an organic solvent.

14. A method for producing gasoline fraction having a reduced sulfur content comprising:

contacting an overcut heavy cat naphtha fraction with a hydrotreating catalyst in the presence of hydrogen gas to remove at least a portion of the sulfur present in the overcut heavy cat naphtha fraction and produce a low sulfur hydrotreated heavy cat naphtha effluent;

contacting the low sulfur hydrotreated heavy cat naphtha effluent with a solid adsorbent at a temperature of between about 0° C. and 100° C., wherein the solid adsorbent comprises a solid support, wherein the adsorbent is pretreated by heating to a temperature of between about 400° C. and 600° C. in a nitrogen atmosphere and an oxygen content of between about 0.1 vol. % and 5 vol. %.; and recovering a product stream having reduced sulfur content.

15. The method of claim 14 wherein the product stream has a sulfur content of less than 20 ppm.

16. The method of claim 14 wherein the product stream has a sulfur content of less than 10 ppm.

17. The method of claim 14 wherein contacting the overcut heavy cat naphtha with the hydrotreating catalyst removes up to 95% of the sulfur present and contacting the low sulfur hydrotreated heavy cat naphtha effluent with the adsorbent removes up to 95% of the remaining sulfur.

18. The method of claim 14 further comprising supplying the low sulfur hydrotreated heavy cat naphtha effluent to a liquid-gas separator to remove hydrogen and hydrogen sulfide from the effluent.

19. The method of claim 14 wherein the hydrotreating catalyst comprises:

a catalyst support selected from alumina, silica, silica-alumina, zeolite, synthetic clay, natural clay, activated carbon, activated carbon fiber and carbon black;

at least one metal selected from chromium, molybdenum, tungsten, nickel and cobalt; and optionally including one or more of the elements selected from boron, nitrogen, fluorine, chlorine, phosphorous, potassium, magnesium, sodium, rubidium, calcium, lithium, strontium and barium.

20. The method of claim 14 wherein the adsorbent comprises metal species appended to a surface thereof.

21. The method of claim 20 wherein at least a portion of the metal species are present as sulfides.

22. The method of claim 14 wherein the adsorbent comprises at least one Group IB metal and at least one Group IIB metal.

23. The method of claim 22 wherein the Group IB metal is selected from copper and the Group IIB metal is selected from zinc.

24. The method of claim 14 wherein the adsorbent is an activated carbon having a surface area greater than about 500 $m^2/g$.

25. The method of claim 14 wherein the overcut heavy cat naphtha fraction is contacted with the hydrotreating catalyst at a temperature of between 300° C. and 350° C. and a pressures of between about 0.5 MPa and 5 MPa.

26. The method of claim 14 further comprising regenerating the adsorbent; wherein regeneration of the adsorbent comprises washing the adsorbent with an organic solvent.

* * * * *